US010455888B2

(12) United States Patent
Davenport

(10) Patent No.: US 10,455,888 B2
(45) Date of Patent: Oct. 29, 2019

(54) ATHLETIC SHOE HAVING A CROSS-TRAINING CONFIGURATION AND A WEIGHT-TRAINING CONFIGURATION

(71) Applicant: Nathaniel David Davenport, Columbia, MO (US)

(72) Inventor: Nathaniel David Davenport, Columbia, MO (US)

( * ) Notice: Subject to any disclaimer, the term of this patent is extended or adjusted under 35 U.S.C. 154(b) by 0 days.

(21) Appl. No.: 15/431,959

(22) Filed: Feb. 14, 2017

(65) Prior Publication Data

US 2018/0228242 A1 Aug. 16, 2018

(51) Int. Cl.

| | |
|---|---|
| ***A43B 3/24*** | (2006.01) |
| ***A43B 5/18*** | (2006.01) |
| ***A43B 13/14*** | (2006.01) |
| ***A43B 5/00*** | (2006.01) |
| ***A43B 13/36*** | (2006.01) |

(52) U.S. Cl.

CPC ..... *A43B 3/246* (2013.01); *A43B 5/00* (2013.01); *A43B 5/18* (2013.01); *A43B 13/148* (2013.01); *A43B 13/36* (2013.01)

(58) Field of Classification Search

CPC .. A43B 3/18; A43B 3/246; A43B 5/18; A43B 5/185; A43B 13/148

USPC ..... 36/100

See application file for complete search history.

(56) References Cited

U.S. PATENT DOCUMENTS

| | | | | | |
|---|---|---|---|---|---|
| 237,887 | A * | 2/1881 | McCaffrey | A43B 5/18 | 36/7.5 |
| 1,938,617 | A * | 12/1933 | Augusta | A43B 7/00 | 36/148 |
| 2,287,744 | A * | 6/1942 | Monahan | A43B 3/163 | 36/7.5 |
| 3,009,269 | A * | 11/1961 | Folk | A43B 3/16 | 36/7.5 |
| 5,075,984 | A * | 12/1991 | Shiew | A43B 3/16 | 36/113 |
| 5,644,857 | A * | 7/1997 | Ouellette | A43B 3/24 | 36/127 |
| 5,794,368 | A * | 8/1998 | Kirby | A43B 5/185 | 36/116 |
| 6,345,454 | B1 * | 2/2002 | Cotton | A43B 3/24 | 36/101 |
| 6,860,038 | B1 * | 3/2005 | Stucke | A43B 5/185 | 36/135 |
| 6,948,261 | B1 * | 9/2005 | Grasso | A43B 5/18 | 36/100 |

(Continued)

*Primary Examiner* — Sharon M Prange

(74) *Attorney, Agent, or Firm* — Armstrong Teasdale LLP

(57) ABSTRACT

An athletic shoe is selectively configurable between a weight-training configuration and a cross-training configuration. The athletic shoe includes an upper portion configured to receive a foot and a first sole portion connected to the upper portion. The first sole portion has an inner surface and an outer surface opposite the inner surface. The outer surface is configured to contact a training surface when the athletic shoe is in the cross-training configuration. The athletic shoe also includes a second sole portion removably connected to the first sole portion when the athletic shoe is in the weight-training configuration. The second sole portion includes a first surface and a second surface. The first surface is configured to contact the training surface and the second surface is configured to contact the outer surface when the athletic shoe is in the weight-training configuration.

15 Claims, 3 Drawing Sheets

(56) References Cited

U.S. PATENT DOCUMENTS

| | | | | |
|---|---|---|---|---|
| 8,307,571 | B1 * | 11/2012 | Ceylan | A43B 3/246 36/101 |
| 9,173,448 | B1 * | 11/2015 | Knoblauch | A43B 5/00 |
| 2009/0100721 | A1 * | 4/2009 | Gorynski | A43B 5/185 36/135 |
| 2012/0036738 | A1 * | 2/2012 | Willis | A43B 5/185 36/73 |
| 2013/0104428 | A1 * | 5/2013 | O'Brien | A43B 5/185 36/135 |
| 2015/0264997 | A1 * | 9/2015 | Myles | A43B 7/38 36/81 |

* cited by examiner

ATHLETIC SHOE HAVING A CROSS-TRAINING CONFIGURATION AND A WEIGHT-TRAINING CONFIGURATION

FIELD

The field of the disclosure relates generally to athletic shoes. More particularly, this disclosure relates to an athletic shoe that is selectively configurable between a cross-training configuration and a weight-training configuration.

BACKGROUND

Cross-training exercises are increasing in popularity among exercise enthusiasts and casual exercisers. Cross-training exercises involve switching between different activities within a single workout. For example, during a single workout, a person may switch between cardio activities, such as running and biking, and strength exercises, such as weight training. In addition, some workouts emphasize almost constant exercise intensity and provide little or no rest between activities. The activities are designed to utilize and exercise different body parts. As such, the activities commonly require different equipment and attire for optimal results. However, a person engaging in cross-training exercises often does not switch shoes between activities because switching shoes may require a prolonged break between the activities. As a result, the person's performance may be reduced and the person may have an increased risk of injury.

An increase in participation in cross-training competitions has coincided with the increased popularity of cross-training exercises. Some participants may opt to switch attire between activities to increase their performance during the competitions. For example, participants may wear a cross-training shoe during cardio activities such as running and biking and a weight-training shoe during activities that involve weight training. However, the time spent switching shoes may decrease the score of the participants. Moreover, some participants who are rushing to switch shoes may put the shoes on improperly, which may hurt their performance and increase their risk of injury.

BRIEF DESCRIPTION

In one aspect, an athletic shoe is selectively configurable between a weight-training configuration and a cross-training configuration. The athletic shoe includes an upper portion configured to receive a foot and a first sole portion connected to the upper portion. The first sole portion has an inner surface and an outer surface opposite the inner surface. The outer surface is configured to contact a training surface when the athletic shoe is in the cross-training configuration. The athletic shoe also includes a second sole portion removably connected to the first sole portion when the athletic shoe is in the weight-training configuration. The second sole portion includes a first surface and a second surface. The first surface is configured to contact the training surface and the second surface is configured to contact the outer surface when the athletic shoe is in the weight-training configuration In another aspect, a removable sole for an athletic shoe is provided. The athletic shoe is selectively configurable between a cross-training configuration and a weight-training configuration. The removable sole is connected to a sole portion of the athletic shoe when the athletic shoe is in the weight-training configuration. The removable sole includes a heel portion including a first surface and a second surface opposite the first surface. The first surface is configured to contact a training surface and the second surface is configured to contact an outer surface of the sole portion of the athletic shoe. The removable sole also includes an engagement member for removably connecting the removable sole and the sole portion when the athletic shoe is in the weight-training configuration.

In yet another aspect, a method of assembling an athletic shoe is provided. The athletic shoe is selectively configurable between a weight-training configuration and a cross-training configuration. The method includes connecting a first sole portion to an upper portion configured to receive a foot. The first sole portion has an inner surface and an outer surface opposite the inner surface. The outer surface is configured to contact a training surface when the athletic shoe is in the cross-training configuration. The method also includes removably connecting a second sole portion to the first sole portion to define the weight-training configuration of the athletic shoe. The second sole portion includes a first surface and a second surface. The first surface is configured to contact the training surface and the second surface is configured to contact the outer surface when the athletic shoe is in the weight-training configuration.

BRIEF DESCRIPTION OF THE DRAWINGS

Corresponding reference characters indicate corresponding parts throughout the several views of the drawings.

DETAILED DESCRIPTION OF THE DRAWINGS

The present disclosure is directed generally to an athletic shoe that is configurable between a cross-training configuration and a weight-training configuration. In the cross-training configuration, the athletic shoe has a first sole portion that contacts a training surface to provide optimal performance for the wearer during activities such as running, jumping, biking, and climbing. In the weight-training configuration, the athletic shoe has a second sole portion that removably connects to the first sole portion. The second sole portion is substantially wedge-shaped and provides optimal performance for the wearer during weight training. The athletic shoe is quickly and easily configurable between the two configurations to allow the wearer to switch between activities with minimal down time. For example, the wearer may switch the athletic shoe between the configurations without removing the athletic shoe from the wearer's foot. In addition, in some embodiments, the athletic shoe includes at least one engagement member and a strap to secure the second sole portion in position quickly and easily.

As used herein, the term "training surface" refers to any surface that supports a person. For example, suitable training surfaces may include, without limitation, ground, running tracks, floors, mats, and platforms. As used herein, the term "cross training" refers to exercises involving switching between different activities within a single workout. As used herein, the term "weight training" refers to exercises where a person handles weights.

Figure 1:
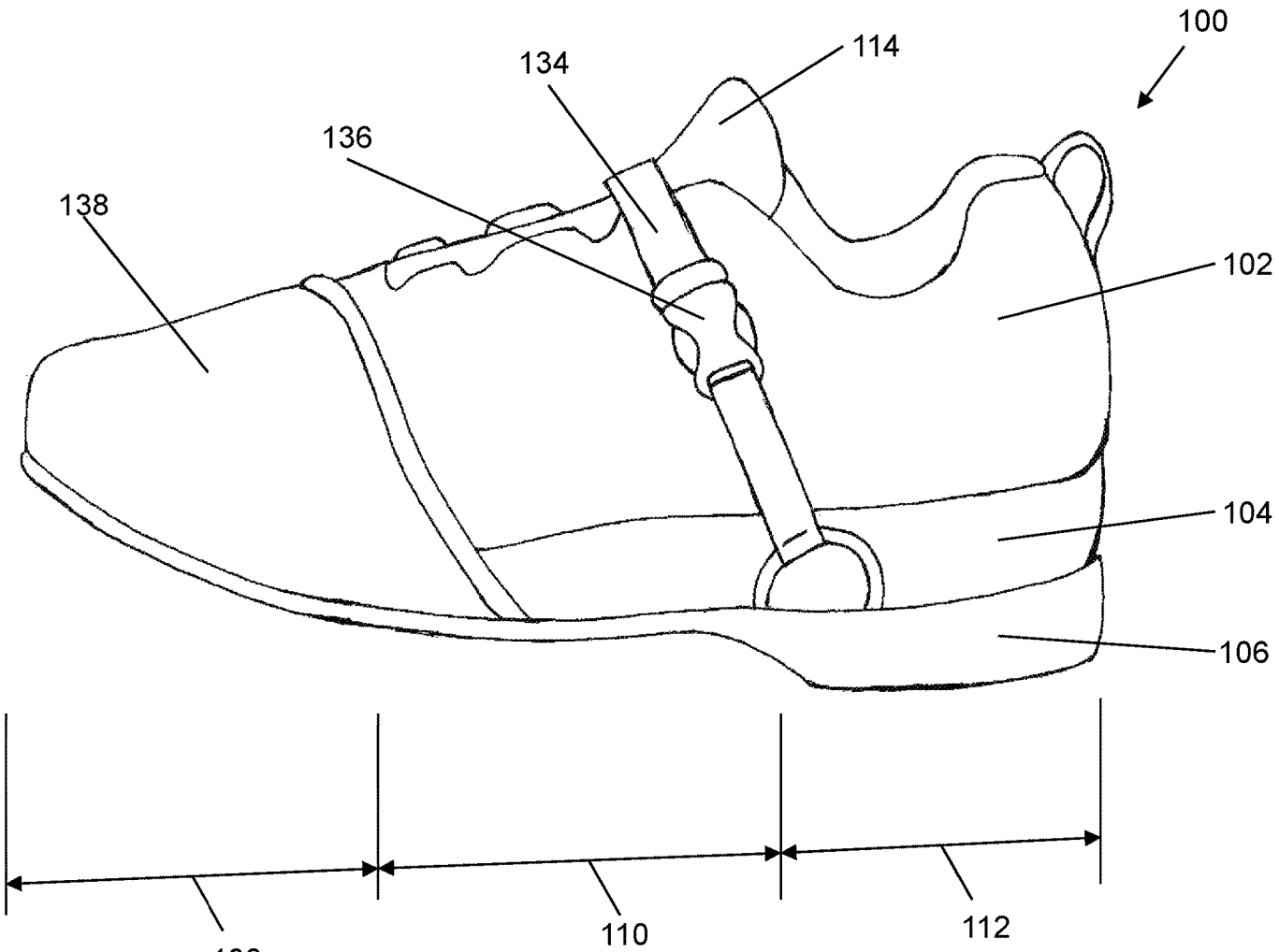
FIG. 1 is a side view of one embodiment of an athletic shoe that is configurable between a cross-training configuration and a weight-training configuration.

Referring now to the drawings and in particular to FIG. 1, one embodiment of an athletic shoe is designated in its entirety by the reference number 100. The athletic shoe 100 is selectively configurable between a cross-training configuration, broadly a first configuration, and a weight-training configuration, broadly a second configuration. As shown in FIG. 1, the athletic shoe 100 includes an upper portion 102, a first sole portion 104, and a second sole portion 106. The first sole portion 104 is configured to contact a training surface when the athletic shoe 100 is in the cross-training configuration. The second sole portion 106 removably connects to the first sole portion 104 and is configured to contact the training surface when the athletic shoe 100 is in the weight-training configuration. In alternative embodiments, the athletic shoe 100 may have any suitable configuration. For example, in some embodiments, the athletic shoe 100 may have a third sole portion that facilitates the wearer participating in specific activities such as climbing and biking.

The upper portion 102 generally includes a toe portion 108, a midfoot portion 110, a heel portion 112, and a tongue 114. The upper portion 102 is configured to receive a foot of a wearer. The athletic shoe 100 may be different sizes to receive different sized feet within the upper portion 102. Also, the athletic shoe 100 may include fasteners including, without limitation, laces, hook and loop fasteners, straps, and buckles. In addition, the upper portion 102 may include elastic to facilitate the athletic shoe 100 sliding on and off of the wearer's foot. In alternative embodiments, the athletic shoe 100 may include any upper portion 102 that enables the athletic shoe to function as described herein.

Figure 2:
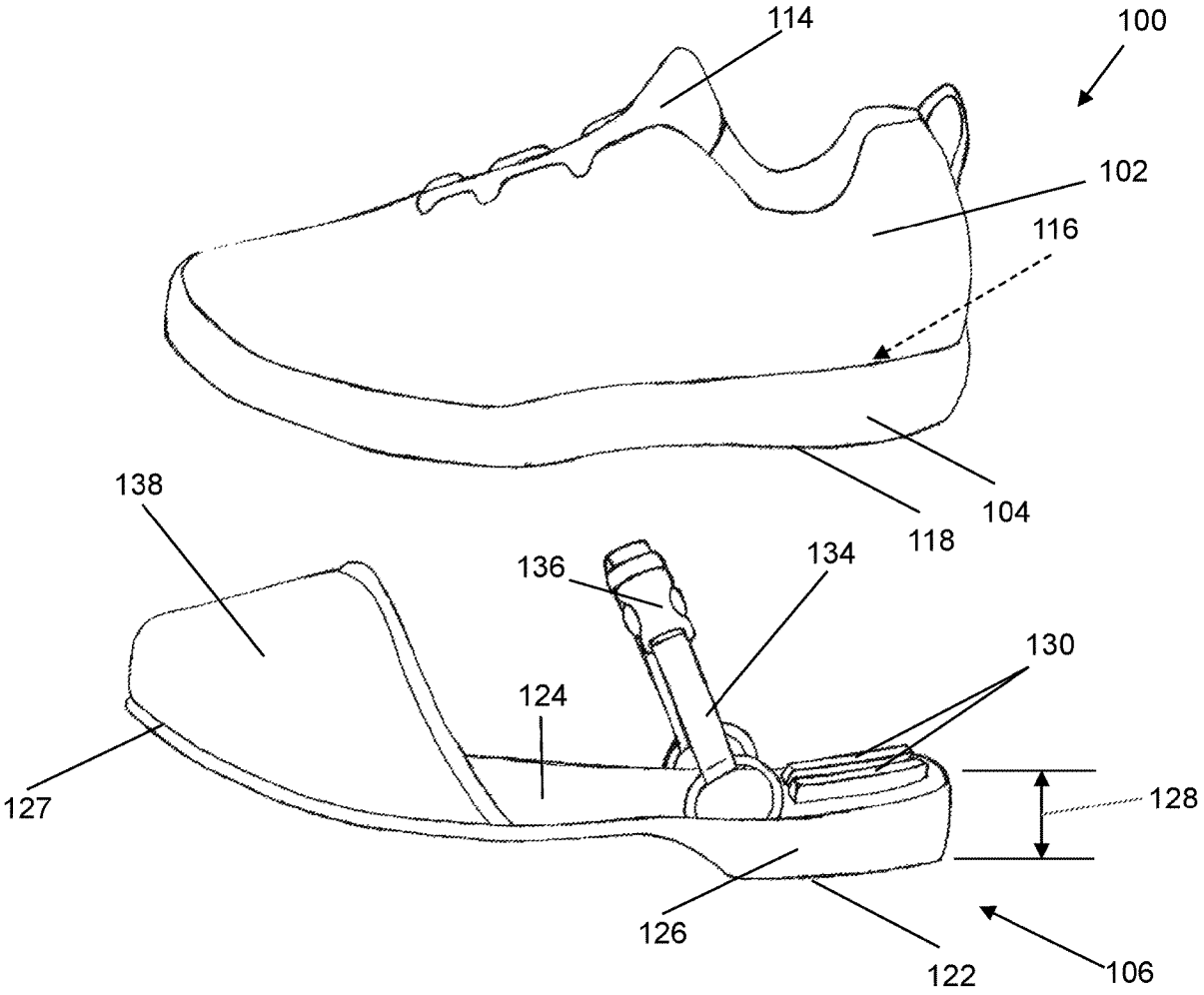
FIG. 2 is a side view of the athletic shoe shown in FIG. 1 with a second sole portion disconnected from a first sole portion.
Figure 3:
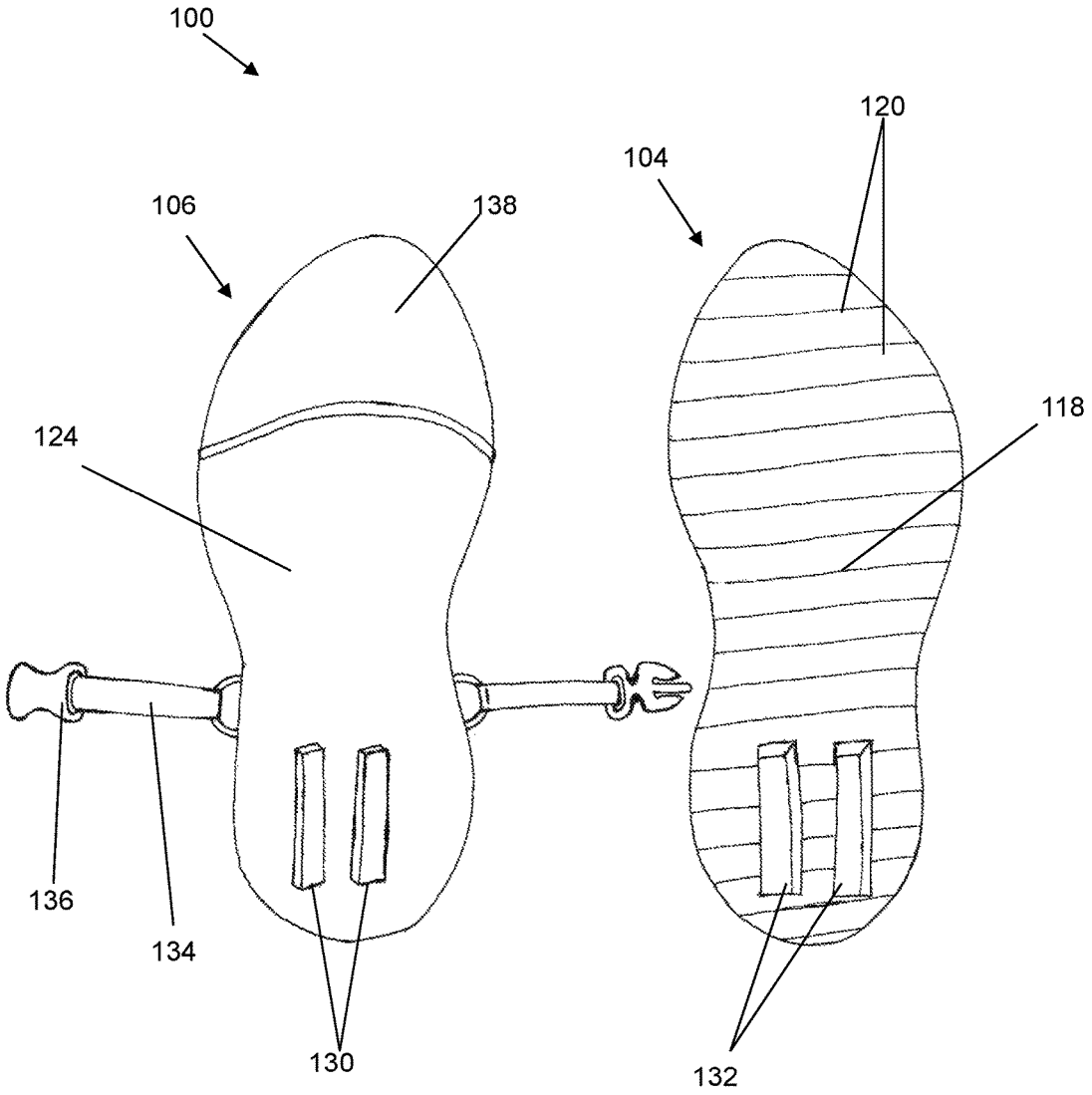
FIG. 3 is an assembly view of the athletic shoe showing a bottom of the first sole portion and a top of the second sole portion.

In reference to FIGS. 2 and 3, the first sole portion 104 is connected to the upper portion 102. The first sole portion 104 has an inner surface 116 and an outer surface 118 opposite the inner surface. The inner surface 116 is on an inside of the athletic shoe 100 adjacent a wearer's foot and is configured to contact the foot, a sock covering the foot, and/or an insole. The outer surface 118 is configured to contact the training surface when the athletic shoe 100 is in the cross-training configuration. Accordingly, the outer surface 118 is contoured to facilitate the wearer performing activities such as running and jumping. In addition, the outer surface 118 extends along the entire foot and provides support to the foot. Also, the outer surface 118 includes grips 120 to provide traction between the athletic shoe 100 and the training surface. In alternative embodiments, the athletic shoe 100 may include any sole portion that enables the athletic shoe 100 to function as described herein.

The second sole portion 106 removably connects to the first sole portion 104 when the athletic shoe 100 is in the weight-training configuration. The second sole portion 106 includes a first surface 122 and a second surface 124. The first surface 122 is configured to contact the training surface and the second surface 124 is configured to contact the outer surface 118 of the first sole portion 104 when the athletic shoe 100 is in the weight-training configuration. In particular, the second surface 124 is configured to contact the outer surface throughout the first sole portion 104 such that the second sole portion 106 extends along the entire foot.

As shown in FIG. 2, the second sole portion 106 includes a heel portion 126 and toe portion 127. A thickness 128 of the second sole portion 106 is defined between the first surface 122 and the second surface 124. The thickness 128 varies from a minimum thickness at toe portion 127 to a maximum thickness at heel portion 126. Accordingly, the second sole portion 106 has a wedge shape. In particular, the heel portion 126 elevates a heel of the wearer above a toe of the wearer and provides support to the wearer during weight training.

In this embodiment, the second sole portion 106 has a maximum thickness in a range of about 20 millimeters (mm) to about 25 mm. Also, the second sole portion 106 has a minimum thickness in a range of about 10 millimeters (mm) to about 15 mm. In alternative embodiments, the second sole portion 106 has any thickness that enables the athletic shoe 100 to function as described herein.

In reference to FIG. 3, the athletic shoe 100 includes at least one engagement member to removably connect the first sole portion 104 to the second sole portion 106. In particular, the second sole portion 106 includes projections 130 that fit within slots, more broadly openings, 132 in the first sole portion 104. Projections 130 extend from the second surface 124 and are configured to extend into the slots 132. Slots 132 are defined in the outer surface 118 and are configured to receive the projections 130. In the exemplary embodiment, the athletic shoe 100 includes two projections 130 and two slots 132. Each projection 130 is an elongate rectangular cuboid. Each slot 132 is approximately the same size as or slightly larger than the projection 130 to provide a tight fit between the projection and the slot. The projections 130 and the slots 132 secure the second sole portion 106 in position relative to the first sole portion 104. In addition, the projections 130 and the slots 132 allow the second sole portion 106 to quickly and easily connect to the first sole portion 104. In alternative embodiments, the athletic shoe 100 may include any engagement member that enables the athletic shoe 100 to function as described herein. For example, in some embodiments, at least one of the first sole portion 104 and the second sole portion 106 may include, without limitation, any of the following: a clip, hook and loop fasteners, and a catch. For example, in some embodiments, an engagement member such as a biased catch may at least partially connect the first sole portion 104 and the second sole portion 106. The biased catch may be configured to automatically engage when the second sole portion 106 is moved into position relative to the first sole portion 104. The biased catch may be disengaged when a user presses an actuator.

As shown in FIGS. 1 and 2, a strap 134 is connected to the second sole portion 106 to secure the second sole portion in position when the athletic shoe is in the weight-training configuration. The strap 134 extends from one side of the second sole portion 106 to the other side of the second sole portion to form a loop that is configured to extend over the upper portion 102. In particular, the strap 134 extends over the midfoot portion 110 of the upper portion 102. The strap 134 is adjustable to facilitate the strap 134 fitting over the upper portion 102. The strap 134 includes a buckle, more broadly a connector, 136. In alternative embodiments, the athletic shoe 100 may include any strap that enables the athletic shoe to function as described herein. For example, in some embodiments, the strap 134 is configured to fit over different upper portions 102 to allow the second sole portion 106 to couple to athletic shoes 100 of different sizes.

In this embodiment, the second sole portion 106 further includes a toe cover 138 configured to receive the toe portion 108 of the upper portion 102. The toe cover 138 facilitates the second sole portion 106 connecting to the first sole portion 104. During operation, the wearer slides the athletic shoe 100 into the toe cover to position the second sole portion 106 relative to the first sole portion 104. In alternative embodiments, the athletic shoe 100 may include any portion that enables the athletic shoe to function as described herein.

During use, a wearer positions a foot into the upper portion 102 such that a sole of the foot is adjacent and extends along the first sole portion 104. The wearer may tighten laces of the athletic shoe 100 to adjust the fit of the athletic shoe. The wearer then may perform an activity such as running and jumping while the athletic shoe is in the cross-training configuration. Between different activities, the wearer may switch the athletic shoe 100 between the cross-training configuration and the weight-training configuration in a minimal amount of time because the second sole portion 106 is configured to easily and quickly connect to the first portion 104 while the athletic shoe remains on the foot of the wearer. The wearer may connect the second sole portion 106 to the first sole portion 104 by sliding the toe portion 108 into the toe cover 138, positioning the projections 130 into the slots 132, and positioning the strap 134 over the upper portion 102. When the athletic shoe 100 is in the weight-training configuration, the wearer may perform activities such as weight training. In alternative embodiments, the wearer may switch the athletic shoe between configurations in any suitable manner. For example, in some embodiments, the wearer may switch the athletic shoe 100 between configurations while the wearer's foot is not positioned within the athletic shoe. In addition, the wearer may put the athletic shoe 100 on while the athletic shoe is in either the weight-training configuration or the cross-training configuration.

The athletic shoes described herein switch between a cross-training configuration and a weight-training configuration. In the cross-training configuration, the athletic shoe has a first sole portion that contacts the training surface to provide optimal performance for the wearer during activities such as running, jumping, biking, and climbing. In the weight-training configuration, the athletic shoe has a second sole portion that removably connects to the first sole portion. The second sole portion is substantially wedge-shaped and provides optimal performance for the wearer during weight training. The athletic shoe is quickly and easily configurable between the two configurations to allow the wearer to switch between activities with minimal down time. For example, the wearer may switch the athletic shoe between the configurations without removing the athletic shoe from the wearer's foot. In addition, in some embodiments, the athletic shoe includes at least one engagement member and a strap to secure the second sole portion in position quickly and easily.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense. Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An athletic shoe selectively configurable between a weight-training configuration and a cross-training configuration, said athletic shoe comprising:

an upper portion configured to receive a foot;

a first sole portion connected to the upper portion, the first sole portion having an inner surface and an outer surface opposite the inner surface, wherein the outer surface is configured to contact a training surface when the athletic shoe is in the cross-training configuration;

a second sole portion removably connected to the first sole portion when the athletic shoe is in the weight-training configuration, the second sole portion including a first surface, a second surface, and sides extending between the first surface and the second surface, wherein the first surface is configured to contact the training surface and the second surface is configured to contact the outer surface when the athletic shoe is in the weight-training configuration, wherein the first sole portion is configured to extend along the entire foot, and wherein the second surface is configured to contact the outer surface throughout the first sole portion such that the second sole portion is configured to extend along the entire foot and the entire second sole portion is positioned beneath the first sole portion when the second sole portion is connected to the first sole portion, wherein the second sole portion includes a toe portion and an open heel portion, the second sole portion having a minimum thickness at the toe portion and a maximum thickness at the open heel portion such that the second sole portion has a wedge shape, wherein the second sole portion does not include a side extending above the second surface in the open heel portion;

engagement members located in the open heel portion and configured to removably connect the second sole portion and the first sole portion, wherein the engagement members comprise a projection and an opening configured to receive the projection, wherein the projection extends from the second surface, and wherein the opening is defined by the outer surface; and a strap connected to the second sole portion to secure the second sole portion in position when the athletic shoe is in the weight-training configuration, wherein the strap is configured to extend over a portion of the upper portion.

2. The athletic shoe of claim 1 further comprising a toe cover configured to receive a toe portion of the upper portion.

3. The athletic shoe of claim 2, wherein the strap is positioned to extend over a midfoot portion of the upper portion.

4. The athletic shoe of claim 1, wherein the engagement members comprise a plurality of openings and a plurality of projections.

5. The athletic shoe of claim 4, wherein each opening is a slot.

6. The athletic shoe of claim 5, wherein each projection is an elongate rectangular cuboid.

7. The athletic shoe of claim 1, wherein the toe portion includes a toe cover configured to receive a toe portion of the upper portion, and wherein the open heel portion is open to facilitate a user sliding the upper portion into the toe portion, wherein the opening is a slot that receives the projection when the upper portion slides into the toe portion.

8. The athletic shoe of claim 1, wherein the open h portion has a maximum thickness in a range of about 20 millimeters (mm) to about 25 mm.

9. The athletic shoe of claim 8, wherein the toe portion has a minimum thickness in a range of about 10 mm to about 15 mm.

10. A removable sole for an athletic shoe, the athletic shoe including an upper portion configured to receive a foot, the athletic shoe being selectively configurable between a cross-training configuration and a weight-training configuration, the removable sole being connected to a sole portion of the athletic shoe when the athletic shoe is in the weight-training configuration, said removable sole comprising:

a toe portion;

an open heel portion including a first surface, a second surface opposite the first surface, and sides extending between the first surface and the second surface, wherein the first surface is configured to contact a training surface and the second surface is configured to contact an outer surface of the sole portion of the athletic shoe, wherein the removable sole is configured to contact the sole portion of the athletic shoe throughout the sole portion such that the removable sole is configured to extend along the entire foot and the entire open heel portion is positioned beneath the sole portion when the removable sole is connected to the sole portion, wherein the removable sole has a minimum thickness at the toe portion and a maximum thickness at the open heel portion such that the removable sole has a wedge shape, wherein the removable sole does not include a side extending above the second surface in the open heel portion;

an engagement member located in the open heel portion for removably connecting the removable sole and the sole portion when the athletic shoe is in the weight-training configuration, wherein the engagement member comprises a projection extending from the second surface and configured to extend into an opening in the outer surface;

a strap to secure the removable sole in position when the athletic shoe is in the weight-training configuration, wherein the strap is configured to extend over the upper portion of the athletic shoe; and a buckle to releasably secure the strap over the upper portion of the athletic shoe, the buckle including a clip that is insertable into a receiver.

11. The removable sole of claim 10 further comprising a toe cover configured to receive a second toe portion of the upper portion of the athletic shoe.

12. The removable sole of claim 10, wherein the open heel portion has a varying thickness defined between the first surface and the second surface.

13. The removable sole of claim 12, wherein the open heel portion has a maximum thickness in a range of about 20 millimeters (mm) to about 25 mm.

14. The removable sole of claim 13, wherein the toe portion has a minimum thickness in a range of about 10 mm to about 15 mm.

15. A method of assembling an athletic shoe, the athletic shoe being selectively configurable between a weight-training configuration and a cross-training configuration, said method comprising:

connecting a first sole portion to an upper portion configured to receive a foot, the first sole portion having an inner surface and an outer surface opposite the inner surface, wherein the outer surface is configured to contact a training surface when the athletic shoe is in the cross-training configuration;

sliding the first sole portion relative to a second sole portion into a toe portion of the second sole portion, the second sole portion including a first surface, a second surface, and sides extending between the first surface and the second surface;

positioning the second sole portion relative to the first sole portion such that the second surface of the second sole portion contacts the outer surface throughout the first sole portion, wherein the second sole portion is configured to extend along an entire foot and the entire second sole portion is positioned beneath the first sole portion when the second sole portion is connected to the first sole portion, wherein the second sole portion has a minimum thickness at the toe portion and a maximum thickness at an open heel portion such that the second sole portion has a wedge shape, wherein the second sole portion does not include a side extending above the second surface in the open heel portion;

positioning a projection into an opening configured to receive the projection;

removably connecting the second sole portion to the first sole portion to define the weight-training configuration of the athletic shoe wherein the first surface is configured to contact the training surface and the second surface is configured to contact the outer surface when the athletic shoe is in the weight-training configuration, wherein the athletic shoe includes engagement members configured to removably connect the second sole portion and the first sole portion, wherein the engagement members comprise the projection and the opening, wherein the projection extends from the second surface, and wherein the opening is defined by the outer surface; and securing the second sole portion to the athletic shoe using a strap connected to the second sole portion when the athletic shoe is in the weight-training configuration, wherein the strap is configured to extend over a portion of the upper portion.

* * * * *